US011114761B2

(12) United States Patent
Kaverine et al.

(10) Patent No.: US 11,114,761 B2
(45) Date of Patent: Sep. 7, 2021

(54) ANTENNA WITH PARTIALLY SATURATED DISPERSIVE FERROMAGNETIC SUBSTRATE

(71) Applicants: TDF, Montroug (FR); UNIVERSITE DE RENNES 1, Rennes (FR)

(72) Inventors: Evgueni Kaverine, Rennes (FR); Sébastien Palud, Rennes (FR); Franck Colombel, Montfort-sur-Meu (FR); Mohamed Himdi, Rennes (FR)

(73) Assignees: TDF, Montrouge (FR); UNIVERSITE DE RENNES 1, Rennes (FR)

( * ) Notice: Subject to any disclaimer, the term of this patent is extended or adjusted under 35 U.S.C. 154(b) by 0 days.

(21) Appl. No.: 16/652,564

(22) PCT Filed: Oct. 4, 2018

(86) PCT No.: PCT/FR2018/052456
§ 371 (c)(1),
(2) Date: Mar. 31, 2020

(87) PCT Pub. No.: WO2019/069033
PCT Pub. Date: Apr. 11, 2019

(65) Prior Publication Data

US 2020/0235473 A1 Jul. 23, 2020

(30) Foreign Application Priority Data

Oct. 4, 2017 (FR) ..... 1759284

(51) Int. Cl.
*H01Q 9/00* (2006.01)
*H01Q 3/44* (2006.01)
(Continued)

(52) U.S. Cl.
CPC ..... *H01Q 3/44* (2013.01); *H01Q 1/38* (2013.01); *H01Q 1/00* (2013.01); *H01Q 7/005* (2013.01); *H01Q 7/08* (2013.01)

(58) Field of Classification Search
CPC .. H01Q 3/44; H01Q 1/38; H01Q 1/00; H01Q 7/08; H01Q 7/005
(Continued)

(56) References Cited

U.S. PATENT DOCUMENTS 5,327,148 A * 7/1994 How ..... H01Q 1/38 343/700 MS
6,677,901 B1 1/2004 Nalbandian
(Continued)

FOREIGN PATENT DOCUMENTS

CN 106299633 1/2017
EP 2276112 1/2011

OTHER PUBLICATIONS

Ashish Saini et al, "Magneto-dielectric properties of doped fenite based nanosized ceramics over very high frequency range", Engineering Science and Technology, An International Journal, (Jan. 26, 2016), vol. 19, No. 2, doi:10.1016/j.jestch.2015.12.008, ISSN 2215-0986, pp. 911-916, XP055482531 [A] 1-11 * table 1 * * abstract * * p. 912-p. 914 * * figure 3 * * figure 5 * DOI: http://dx.doi.org/10.1016/j.jestch.2015.12.008.
(Continued)

*Primary Examiner* — Joseph J Lauture
(74) *Attorney, Agent, or Firm* — Duane Morris LLP; Gregory M. Lefkowitz

(57) ABSTRACT

The invention concerns an antenna, comprising at least two non-ferrous metal plates, at least one first plate forming a radiating portion and a second plate forming a mass plane, at least one substrate, arranged between the mass plane and the radiating portion, and an excitor of length at least equal
(Continued)

to the thickness of the substrate, extending between the mass plane and the radiating portion and connected to the radiating portion, and adapted to supply the antenna, characterised in that the substrate is a dispersive ferromagnetic substrate, called dispersive ferrite presenting, as magnetic features, a high relative magnetic permeability comprised between 10 and 10,000 and a high magnetic loss tangent greater than 0.1, said antenna comprising means for gradually and locally reducing magnetic features of the dispersive ferrite.

11 Claims, 10 Drawing Sheets

(51) Int. Cl.

| | |
|---|---|
| ***H01Q 1/38*** | (2006.01) |
| *H01Q 1/00* | (2006.01) |
| *H01Q 7/00* | (2006.01) |
| *H01Q 7/08* | (2006.01) |

(58) Field of Classification Search
USPC ..... 343/745, 700 MS, 787, 829, 846
See application file for complete search history.

(56) References Cited

U.S. PATENT DOCUMENTS 8,410,989 B2 4/2013 Hayakawa
2007/0001921 A1 1/2007 Takahashi et al.
2016/0013561 A1 1/2016 Hong et al.

OTHER PUBLICATIONS

Cortes Nino July Paola et al, "Modeling antennas printed on magnetized substrate: Application to the design of a tunable PIFA antenna", 2015 European Microwave Conference (EUMC), EUMA, (Sep. 10, 2015), doi:10.1109/EUMC.2015.7345917, pp. 933-936, XP032823012 [Y] 11 * p. 934; figure 1 * DOI: http://dx.doi.org/10.1109/EuMC.2015.7345917.

D.M. Pozar et al, "Magnetic tuning of a microstrip antenna on a ferrite substrate", Electronics Letters, GB, (Jun. 9, 1988), vol. 24, No. 12, doi:10.1049/el:19880491, ISSN 0013-5194, p. 729, XP055482034 [I] 1-5,10 * figure 1 * p. 729-p. 730 * [Y] 9,11 DOI: http://dx.doi.org/10.1049/el:19880491.

Atif Shamim et al, "Ferrite LTCC-Based Antennas for Tunable SoP Applications", IEEE Transactions on Components, Packaging and Manufacturing Technology, IEEE, USA, (Jun. 27, 2011), vol. 1, No. 7, doi:10.1109/TCPMT.2011.2143411, ISSN 2156-3950, pp. 999-1006, XP011336016 [A] 6-8 * figure 6 * * p. 1002 *DOI: http://dx.doi.org/10.1109/TCPMT.2011.2143411.

Mishra R K et al, "Tuning of Microstrip Antenna on Ferrite Substrate", IEEE Transactions on Antennas and Propagation, IEEE Service Center, Piscataway, NJ, US, (Feb. 1, 1993), vol. 41, No. 2, doi:10.1109/8.214616, ISSN 0018-926X, pp. 230-233, XP000303632 [A] * abstract * DOI: http://dx.doi.org/10.1109/8.214616.

* cited by examiner

ANTENNA WITH PARTIALLY SATURATED DISPERSIVE FERROMAGNETIC SUBSTRATE

CROSS-REFERENCE TO RELATED APPLICATIONS

This application is a § 371 national stage entry of International Application No. PCT/FR2018/052456, filed Oct. 4, 2018, which claims priority of French National Application No. 1759284, filed Oct. 4, 2017, the entire contents of which are incorporated herein by reference.

1. TECHNICAL FIELD OF THE INVENTION

The invention concerns an antenna on a ferromagnetic substrate. In particular, the invention concerns an antenna on an ultracompact ferromagnetic substrate in the vertical plane compared with the wavelength, which could be used in reception or in emission in the kilometric (30-300 kHz), hectometric (0.3-3 MHz), decametric (3-30 MHz) and metric (30-300 MHz) frequency bands.

The antenna is particularly suitable, for example, in broadband or narrowband emission systems with a medium to high-power conveying information in the form of signals modulated or not and which are spread by radio. According to certain embodiments, the antenna favours the propagation of the wave in a favoured direction (directive antenna).

2. TECHNOLOGICAL BACKGROUND

Electrically small antennas have an impedance presenting a strong reactive component which does not allow their use in an effective and direct manner in standardised real impedance systems (typically 50Ω).

The adaptation of impedance of this type of antenna is often difficult and generally allows matching only on a narrow band of frequencies. The narrow bandwidth of such an antenna is often unstable which is particularly problematic upon emission, in particular for high-power applications.

Solutions have been sought to stabilise this variation of impedance and thus increase the bandwidth of the antenna. However, these solutions significantly decrease the effectiveness of the antenna, thus making it unusable under the desired conditions.

In the article entitled "Magnetic tuning of a microstrip antenna on a ferrite substrate" published in *Electronic Letters,* 9 Jun. 1998, Vol. 24, No. 12, pp. 730-731 (referenced D1 below), D. M. Pozar and V. Sanchez describe impedance matching of a microstrip antenna on a ferrite substrate for high-frequencies applications, i.e. greater than 2.8 GHz. For this, the application of a magnetic field to said substrate constituted of YIG G-113 of ferrimagnetic type and presenting low losses at high frequencies is described. It has been observed that the use of this material limits the miniaturisation factor of the antenna.

In the article entitled, "Magneto-dielectric properties of doped ferrite based nanosized ceramics over very high frequency range", published in *Engineering Science and Technology, an International Journal* 19 (2016) pp. 911-916, Ashish Saini et al. describe a magneto-dielectric material of which they seek to reduce the dielectric and magnetic losses to miniaturise radar antennas operating at around 100 MHz.

3. AIMS OF THE INVENTION

The invention aims to overcome at least some of the disadvantages of known electrically small antennas.

In particular, the invention aims to provide, in at least one embodiment of the invention, an antenna with ultracompact vertical polarisation in the vertical plane and broadband which can operate upon emission.

The invention also aims to provide, in at least one embodiment, an antenna ensuring a good radiation effectiveness while conserving a broad bandwidth by stabilising the variation of the impedance.

The invention also aims to provide, in at least one embodiment of the invention, a directional antenna (or directive antenna).

4. SUMMARY OF THE INVENTION

To do this, the invention concerns an antenna, comprising:

- at least two non-ferrous metal plates extending mainly according to a horizontal plane, at least one first plate forming a radiating portion and a second plate forming a mass plane,
- at least one substrate, extending mainly according to a horizontal plane, arranged between the mass plane and the radiating portion,
- an excitor of length at least equal to the thickness of the substrate, extending between the mass plane and the radiating portion and connected to the radiating portion, and adapted to supply the antenna, characterised in that the substrate is a dispersive ferromagnetic substrate, called dispersive ferrite, presenting as magnetic features, a relative high magnetic permeability comprised between 10 and 10,000 and a high tangent of magnetic losses greater than 0.1, said antenna comprising means for locally modifying the magnetic features of the dispersive ferrite, such that the relative magnetic permeability and the magnetic losses of the dispersive ferrite are gradually and locally reduced.

By definition, a dispersive ferrite presents high dielectric losses and/or high magnetic losses. The dispersive ferromagnetic substrate used in the scope of the present invention is constituted, in particular, of spinel ferrite which is well-adapted to the production of magnetic antennas with a broad bandwidth and small. An antenna according to the invention therefore makes it possible, thanks to the use of a partially saturated dispersive ferromagnetic substrate (dispersive ferrite) (i.e. of which the magnetic losses and the relative magnetic permeability are locally and gradually reduced), to ensure a good radiation effectiveness while conserving a broad bandwidth by stabilising the variation of the impedance. Indeed, the dispersive ferrite makes it possible for this stabilisation of the impedance, but highly reduces the radiation. In addition, the dispersive ferrite can see a rapid heating and a degradation of performances in the vicinity of the Curie point during long-duration and high-power emissions. The gradual and local modification of the features of the ferrite makes it possible to compensate for this radiation reduction in order to achieve a suitable gain, while conserving the stabilisation of the impedance, and with a reduced heating in emission mode.

The antenna thus produced is an antenna with an ultracompact vertical polarisation in the vertical plane (height of $\lambda/1400$ for example at $\lambda$=30 MHz) and broadband which can operate upon emission. The terms "vertical plane" and "horizontal plane" are understood by considering the antenna in its arrangement during its preferable operation in vertical polarisation, the antenna could, of course, have a different orientation when it is not operating and/or when the desired polarisation is different (in particular, horizontal).

A high relative magnetic permeability is typical from ferromagnetic materials, and is broadly greater than 1, in particular comprised between 10 and 10,000. The high tangent of magnetic losses, corresponding to high magnetic losses, is often designated by the symbol tan δ of which the value is greater than 0.1. The tangent of magnetic losses corresponds to the ratio of the imaginary portion over the real portion of the relative magnetic permeability. The high value of these magnetic features depends on the frequency used. These values are provided at the working frequency of the antenna, i.e. at a frequency within a band of frequencies on which the adaptation of impedance of the antenna is achieved. In the scope of the present invention, it is reminded that the antenna is adapted to receive or emit at a frequency within kilometric (30-300 kHz), hectometric (0.3-3 MHz), decametric (3-30 MHz) or metric (30-300 MHz) frequency bands. Thus, the maximum working frequency of the antenna is of around 300 MHz (i.e. corresponding to the upper limit of the metric frequency band 30-300 MHz).

At these frequencies, in particular at frequencies located at the bottom of the bands (i.e. 30 kHz, 0.3 MHz or 30 MHz), the high relative magnetic permeability of the dispersive ferrite makes it possible to increase the miniaturisation factor of the antenna. For example, the antenna illustrated in FIG. 1 has a maximum size of less than 0.03λ, at a working frequency equal to 30 MHz (λ designating the corresponding wavelength) or less than 0.01λ by only considering the radiating metal portions of the antenna.

By comparison, the maximum dimension of the radiating portion of the antenna of D1 would be limited to 0.22λ, at this same working frequency. Such a limitation comes from the fact that only the increased permittivity of the material YIG G-113 contributes to reducing the size of the antenna. On the contrary, the magnetic permeability and the relative permeability of the dispersive ferrite according to the specifics of the invention both contribute to increasing the miniaturisation factor of the antenna and with the particularity that the contribution of the magnetic permeability is higher than that of the permittivity. The gradual and local modification makes it possible to locally and gradually reduce these values, in particular until a relative magnetic permeability less than the permeability of the ferrite, typically comprised between 1 and 100 and always greater than 1, and a tangent of lower magnetic losses. The dispersive ferrite is thus non-homogenous.

The antenna furthermore presents a directivity in the horizontal plane, without requiring being put in a network with other antennas nor resorting to one or more external parasitic elements.

The non-ferrous metal forming the plates is, for example, copper, brass, aluminium, etc.

According to the embodiments, the local modification means of the magnetic features of the dispersive ferrite are a magnet (permanent magnet or electromagnet), or at least one material part having a low relative magnetic permeability and a low loss tangent.

The magnet is arranged on a metal plate of the antenna, preferably on the radiating portion.

When the magnet is an electromagnet, it is supplied by a direct current generator, preferably variable, thus making it possible to modify the force of the magnetic field generated by the electromagnet, thus modifying the performances of the antenna (parameters S, gain and form of the radiation diagram). The gain can, for example, vary on command, or the impedance can be adjusted to reach that desired in the system to which the antenna is connected, for example 50Ω.

The material part(s) inserted are included in producing the ferrite. The arrangement of the parts can be configured to reach desired performances.

Advantageously and according to the invention, the dispersive ferrite presents a size in the horizontal plane greater than the size of the metal plates.

According to this aspect of the invention, the size of the ferrites greater than the metal plates makes it possible to improve the effectiveness of the radiation. If the antenna is of the monopole type, this feature also makes it possible to increase the directivity. The size of the ferrites can be greater in one single direction.

Advantageously and according to the invention, the antenna comprises at least one short-circuit connecting the mass plane and the radiating portion, in contact with an edge of the dispersive ferrite.

According to this aspect of the invention, an antenna with no short-circuit is an antenna of the monopole type, an antenna presenting a short-circuit is an antenna of the semi-open type, and an antenna presenting a short-circuit arranged opposite the excitor at the level of the edge of the dispersive ferrite forms an antenna of the loop type.

Advantageously and according to the invention, the antenna comprises a succession of dispersive ferrite and of magnets stacked alternatively between the radiating portion and the mass plane.

According to this aspect of the invention, the antenna thus forms a stacked antenna.

The stacked antennas make is possible to achieve greater gains. Furthermore, it is possible to make the degree of saturation of the dispersive ferrites vary according to the layers, thus making it possible for a modification of the adaptation, of the gain and of the radiation.

Advantageously and according to the latter aspect of the invention, the radiating portion comprises a metal plate between each ferrite and magnet.

Advantageously and according to the latter aspect of the invention, the metal plates are connected between them.

The invention also concerns an antenna, characterised in combination by all or some of the features mentioned above or below.

5. LIST OF FIGURES

Other aims, features and advantages of the invention will appear upon reading the following description given only in a non-limiting manner and which refers to the appended figures, wherein:

FIG. 1 is a schematic, perspective, exploded view of an antenna according to a first embodiment of the invention, FIG. 2 is a schematic, perspective, exploded view of an antenna according to a second embodiment of the invention, FIG. 3 is a schematic, lateral cross-sectional view of an antenna according to the first embodiment of the invention, FIG. 4 is a schematic, lateral cross-sectional view of an antenna according to a third embodiment of the invention, FIG. 5 is a schematic, lateral cross-sectional view of an antenna according to the second embodiment of the invention, FIG. 6 is a magnetic field mapping representing the distribution of the radiofrequency magnetic field in the dispersive ferrite of an antenna as a top view according to the first embodiment of the invention with no magnet, FIG. 7 is a magnetic field mapping representing the distribution of the radiofrequency magnetic field in the dispersive ferrite of an antenna as a top view according to the first embodiment of the invention with a magnet, FIG. 8 is a magnetic field mapping representing the distribution of the static magnetic field in the dispersive ferrite of an antenna as a top view according to the first embodiment of the invention with a magnet, FIG. 9 is a graph representing the magnetic loss tangent in the dispersive ferrite of an antenna according to an embodiment of the invention according to the frequency, in the absence or in the presence of magnets having different magnetic induction values, FIGS. 10*a* and 10*b* are graphs representing respectively the real portion of the imaginary portion of the relative magnetic permeability in the dispersive ferrite of an antenna according to an embodiment of the invention according to the frequency, in the absence or in the presence of magnets having different magnetic induction values, FIGS. 11*a*, 11*b* and 11*c* are schematic views from the top of the dispersive ferrite of antennas according to different embodiments of the invention, comprising a magnet, FIG. 12 is a schematic view of the top of an antenna according to an embodiment of the invention, comprising an electromagnet, FIG. 13 is a graph representing the reflection coefficient $S_{11}$ of an antenna according to the first embodiment of the invention in the absence or in the presence of magnets having different magnetic induction values, FIG. 14 is a graph representing the reflection coefficient $S_{11}$ of an antenna according to the first embodiment of the invention in the absence or in the presence of a permanent magnet of 2000 Gauss (G), FIG. 15 is a graph representing the reflection coefficient $S_{11}$ of an antenna according to the second embodiment of the invention in the absence or in the presence of a permanent magnet of 2000 Gauss (G), FIG. 16 is a diagram of radiation of an antenna according to the first embodiment of the invention in the absence or in the presence of a permanent magnet of 2000 Gauss (G), FIG. 17 is a diagram of radiation of an antenna according to the second embodiment of the invention in the absence or in the presence of a permanent magnet of 2000 Gauss (G), FIGS. 18*a*, 18*b* and 18*c* are schematic views of the top of antennas according to different embodiments of the invention, comprising an inserted part, FIG. 19 is a schematic, perspective view of a so-called stacked antenna, according to a fourth embodiment of the invention, FIG. 20 is a schematic, perspective view of a so-called stacked antenna, according to a fifth embodiment of the invention, FIG. 21 is a schematic, perspective view of a so-called stacked antenna, according to a sixth embodiment of the invention, FIG. 22 is a schematic, perspective view of a so-called stacked antenna, according to a seventh embodiment of the invention, FIG. 23 is a schematic, perspective view of a so-called stacked antenna, according to an eighth embodiment of the invention, FIG. 24 is a schematic, perspective view of a so-called stacked antenna, according to a ninth embodiment of the invention, FIG. 25 is a schematic, perspective view of a so-called stacked antenna, according to a tenth embodiment of the invention, FIG. 26 illustrates examples of positioning the magnet on the radiating portion of the antenna in the case of a monopole antenna, FIG. 27 illustrates an example of positioning of the magnet on the radiating portion of the antenna in the case of a semi-open antenna (loop).

6. DETAILED DESCRIPTION OF AN EMBODIMENT OF THE INVENTION

The following embodiments are examples. Although the description refers to one or more embodiments, this does not necessarily mean that each reference concerns the same embodiment, or that the features apply only to one single embodiment. Simple features of different embodiments can also be combined to provide other embodiments. In the figures, the scales and the proportions are not strictly respected and this, for purposes of illustration and clarity.

The magnetic induction values of the magnets is expressed in Gauss in this application, 1 Gauss (with symbol G) worth $10^{-4}$ Tesla (with symbol T).

The antennas represented are arranged according to their preferable operating mode with a vertical polarisation. $\lambda$ means the wavelength with the main frequency (central frequency if emission on a frequency band) for emission or reception from the antenna.

FIG. 1 represents schematically in an exploded perspective manner an antenna according to a first embodiment of the invention. FIG. 3 schematically, laterally cross-sectionally represents an antenna according to the first embodiment of the invention.

The antenna comprises two non-ferrous metal plates (for example, copper, brass, aluminium, etc.), a first plate forming a radiating portion $\mathbf{4}_H$ and a second plate forming a mass plane $\mathbf{4}_B$. Between the two metal plates, a dispersive ferromagnetic substrate is arranged, called dispersive ferrite 1. The metal plates and the dispersive ferrite 1 are presented in a flat form extending mainly according to a horizontal plane, so as to present a minimum vertical size for an antenna with vertical polarisation.

The radiating portion $\mathbf{4}_H$ totally or partially covers the dispersive ferrite 1, and can be composed of several parts having different forms connected between them. The radiating portion $\mathbf{4}_H$ can also be presented in several complex forms, for example a maze as represented in reference to FIG. 25 according to an embodiment of the invention.

In this embodiment, the dispersive ferrite 1 presents a horizontal size greater than the metal plates, in particular according to a length (the plates are square while the dispersive ferrite 1 is rectangular), which makes it possible to improve the radiation (greater gain). According to other embodiments, the ferrite and the plates have the same size in the horizontal plane or of different forms.

The dispersive ferrite 1 comprises an orifice 8 making it possible to pass through an excitor 6 connected to a connector 7. When the connector 7 is a coaxial type socket, its core is connected to the excitor 6 and its outer conductor is connected to the mass plane. The radiating portion and the mass plane are not directly connected by a conductive element such as a short-circuit, the antenna thus formed being a monopole antenna.

The antenna comprises local modification means of the magnetic features of the dispersive ferrite, here a magnet 5 arranged on one of the metal plates, preferably the radiating portion as represented in this embodiment. By arranging the magnet 5 on the radiating portion of the antenna, it is possible to achieve a greater antenna efficiency with a greater gain in a given direction.

For example, the magnet 5 has a rectangular form. It has a length of 47 mm, a width of 22 mm and a height of 12 mm.

The substrate is constituted by a ferrite tile made of material referenced 4S60. The tile is of square form. It has a length of 100 mm, a width of 100 mm and a thickness of 7 mm. Thus, the magnet 5 has a surface area corresponding to around 10.34% of the total surface area of the substrate. Such proportions ensure, in particular, a local and gradual modification of the magnetic features of the dispersive ferrite by the magnet.

The distance between the radiating portion and the mass plane, corresponding to the thickness of the ferrite, is generally comprised between λ/50,000 and λ/500 according to the frequency used.

FIG. 2 represents schematically in perspective and in an exploded manner represents an antenna according to a second embodiment of the invention. FIG. 5 schematically, laterally cross-sectionally represents an antenna according to the second embodiment of the invention.

The second embodiment is identical to the first embodiment of the invention, except for the presence of a short-circuit 2 connecting the radiating portion to the mass plane, the short-circuit 2 being extended from the excitor 6 so as to form an antenna of the semi-open type (or semi-open loop) thanks to the absence of any short-circuit at the level of the zone 3 opposite the short-circuit 2.

FIG. 4 schematically, laterally cross-sectionally represents an antenna according to a third embodiment of the invention.

This embodiment is similar to the second embodiment wherein the excitor 6 is no longer arranged at the centre of the ferrite and passing through it, but on an edge of the ferrite so as to extend between the mass plane $\mathbf{4}_B$ and the radiating portion $\mathbf{4}_H$, at the level of the opening of the second embodiment. The excitor 6, the radiating portion $\mathbf{4}_H$, the short-circuit 2 and the mass plane $\mathbf{4}_B$ thus form a loop, the antenna also being an antenna of the loop type.

FIG. 6 is a magnetic field mapping representing the distribution of the radiofrequency magnetic field in the dispersive ferrite of an antenna as a top view according to the first embodiment of the invention with no magnet, and FIG. 7 is a magnetic field mapping representing the distribution of the radiofrequency magnetic field in the dispersive ferrite of an antenna as a top view according to the first embodiment of the invention with a magnet. The radiofrequency magnetic fields are measured in dB μA/m. FIG. 8 is a magnetic field mapping representing the distribution of the static magnetic field in the dispersive ferrite of an antenna as a top view according to the first embodiment of the invention with a magnet. The static magnetic field is expressed in Gauss (G). For example, the magnet 5 is a permanent magnet emitting a static field of 2000 G, that is 0.2 Tesla (T).

In FIG. 7, the introduction of an amplitude dissymmetry is noted, due to the inhomogeneity of the static command field generated by the magnet (represented in FIG. 8). This static field generated by the magnet causes a local modification of the features of the dispersive ferrite. In particular, this modification is a local and gradual reduction of the relative magnetic permeability and of the magnetic losses of the dispersive ferrite. From a standpoint of operating the antenna, this is conveyed by a dissymmetry in the diagram of radiation which leads to an increase of the directivity of the antenna, as can be seen, for example, in FIG. 16. Complementarily, as the relative magnetic permeability and the ferrite losses are reduced (see FIG. 9), the gain is increased very favourably.

To form this dissymmetry, the magnet 5 is advantageously arranged off-centred with respect to the excitor 6. Preferably, the magnet 5 abuts one of the sides of the ferrite substrate 1. For example, when the antenna is of the monopole type, the magnet 5 is preferably arranged in one of the four zones 51, 52, 53, 54, as illustrated in FIG. 26. When the antenna is of the semi-open type, the magnet 5 is preferably arranged at the level of the zone which forms the opening (referenced 3 in FIGS. 2 and 5). In this case, the magnet 5 is arranged in an off-centred zone 50, opposite the short-circuit 2 as illustrated in FIG. 27.

In the example described above in reference to FIG. 1, the magnet 5 covers around 10.34% of the surface area of the substrate 1. However, the magnet 5 can also cover all of the surface area of the ferrite, in which case the diagram of radiation is not modified, but the antenna has a better radiation effectiveness.

The dispersive ferrite with no local modification of the features makes it possible to stabilise the variation of the impedance of the antenna and thus increase the bandwidth of the antenna, but leads to a drop in radiation effectiveness. The local modification of the features makes it possible to conserve this advantage in stabilising the impedance variation and increasing bandwidth while compensating for the drop in radiation effectiveness so as to obtain an efficient antenna.

FIG. 9 is a graph representing, on a logarithmic scale, the magnetic losses, represented by the magnetic loss tangent in the dispersive ferrite of an antenna according to an embodiment of the invention, according to the frequency (in MHz on a logarithmic scale), in the absence (curve 0 G) or in the presence of magnets having different magnetic induction values (620 G, 1680 G and 2410 G). FIGS. 10*a* and 10*b* are graphs respectively representing the real portion and the imaginary portion of the relative magnetic permeability in the dispersive ferrite of an antenna according to an embodiment of the invention according to the frequency (in MHz on a logarithmic scale), in the absence (curve 0 G) or in the presence of magnets having different magnetic induction values (620 G, 1680 G and 2410 G). The experimental results presented in the diagrams of FIGS. 9 and 10 have been obtained with an NiZn ferrite, commercially available under reference 4S60 and commonly used for their properties of attenuating radio waves with frequencies greater than 1 GHz.

Similar results can be obtained with other dispersive ferrites, in particular spinel ferrites, both presenting a high relative magnetic permeability comprised between 10 and 10,000 and a high magnetic loss tangent greater than 0.1. It is reminded that the relative magnetic permeability and the magnetic loss tangent depend not only on the material, but also on the working frequency of the antenna in question. In the scope of the present invention, the working frequency remains less than 300 MHz.

Real and imaginary portions of the relative magnetic permeability are commonly designated respectively by the symbols μ' and μ".

The magnetic loss tangent (often designated by the symbol tan δ) is the ratio of the imaginary portion over the real portion of the relative magnetic permeability.

The magnetic loss tangent and the real and imaginary portions of the relative magnetic permeability are measured in the dispersive ferrite at the level of the zones where the magnetic features of the dispersive ferrite are modified.

As can be seen in the graphs, in the presence of a magnet, the magnetic losses and the relative magnetic permeability decrease, making it possible to obtain the effects on the gain and the radiation described above. This reduction is greater than the magnetic induction value of the magnet.

In the graphs of FIGS. 10*a* and 10*b*, the reduction of the relative magnetic permeability can be particularly seen in the frequencies between 1 and 30 MHz, which forms part of the frequency band aimed for by the invention. Beyond 100 MHz, the relative magnetic permeability is low in all cases.

The dispersive spinel ferrites, in particular NiZn, known for presenting a high magnetic permeability are generally used to form coatings intended to absorb electromagnetic waves, in particular the walls of the anechoic chambers operating at frequencies up to 1000 MHz. In the scope of the present invention, advantageously this type of ferrite is used.

FIGS. 11*a*, 11*b* and 11*c* schematically represent the top of the antennas according to different embodiments of the invention, comprising a permanent magnet. The form of the magnets can be modified, thus leading to a different distribution of the magnetic field generated. This different distribution leads to a modification of the diagram of radiation of the antenna which can therefore be adapted according to need. The forms represented in the example are rectangular (FIG. 11*a*), circular (FIG. 11*b*) or triangular (FIG. 11*c*).

FIG. 12 schematically represents the top of an antenna according to an embodiment of the invention, comprising an electromagnet 5. The electromagnet can replace a permanent magnet in the different embodiments of the antenna. The electromagnet is supplied by a variable current generator 9, thus making it possible to modify the value of the magnetic field that it generates. It is thus possible to impact on performances such as parameters S of the antenna, the gain and the form of the diagram of radiation.

FIG. 13 is a graph representing the reflection coefficient $S_{11}$ of an antenna according to the embodiment of the invention in the absence (curve 0 G) or in the presence of magnets having different magnetic induction values (780 G, 850 G, 1430 G), for example an electromagnet, according to the frequency (in MHz). The reflection coefficient $S_{11}$ makes it possible to determine the impedance adaptation of the antenna. Using the magnet adapted or by adjustment with an electromagnet, it is thus possible to select the value of the magnetic field so as to have the desired impedance adaptation, for example 50Ω.

Figure 17:
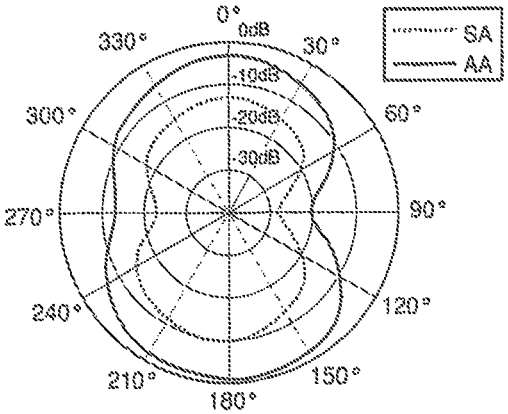

The antenna with no magnet is an omnidirectional antenna of low gain, while the antenna of the monopole type with a magnet according to the invention is directional and has a greater gain in all directions. FIG. 17 is a diagram of radiation of an antenna according to the second embodiment of the invention in the absence (SA curve) or in the presence (AA curve) of a permanent magnet of 2000 G.

The antenna with no magnet is a directional antenna of low gain, while the semi-open antenna with a magnet according to the invention has a substantially similar diagram but presents a greater gain in all directions.

Figure 16:
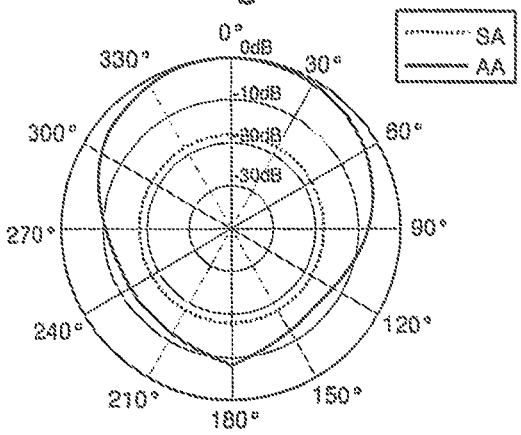
FIG. 16 is a diagram of radiation of an antenna according to the first embodiment of the invention in the absence (SA curve) or in the presence (AA curve) of a permanent magnet of 2000 G.

Generally, the diagram of radiation of the antenna such as represented in FIGS. 16 and 17 can also be adjusted according to the relative position of the magnet 5 with respect to the substrate 1.

Figure 18A:
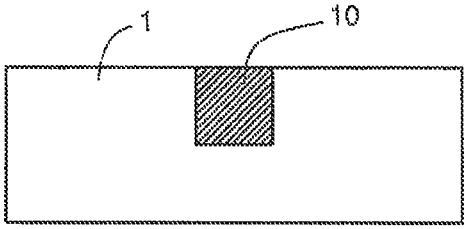
Figure 18B:
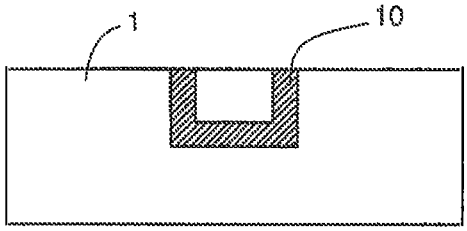
Figure 18C:
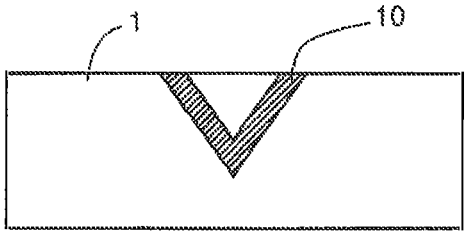

FIGS. 18*a*, 18*b* and 18*c* are schematic views of the top of the dispersive ferrite of antennas according to different embodiments of the invention, comprising an inserted part.

The inserted parts 10 are material parts having a low relative magnetic permeability and of low magnetic losses inserted in the dispersive ferrite and which lead to a gradual and local reduction of the magnetic permeability and of the magnetic losses of the dispersive ferrite.

By low relative magnetic permeability, relative magnetic permeability values are understood to be less than 10. By low magnetic losses, magnetic loss tangent values are understood to be less than 0.1. As indicated above, these values are to be considered at the working frequency of the antenna, i.e. at a frequency within a frequency band on which the impedance adaptation of the antenna is achieved.

Figure 1:
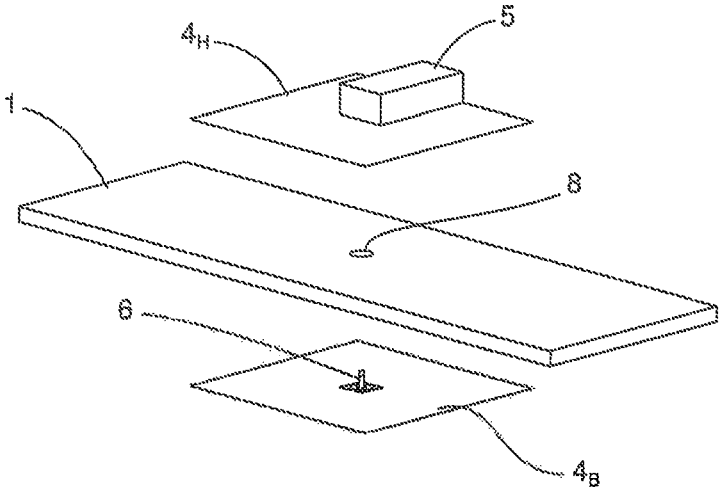
Figure 2:
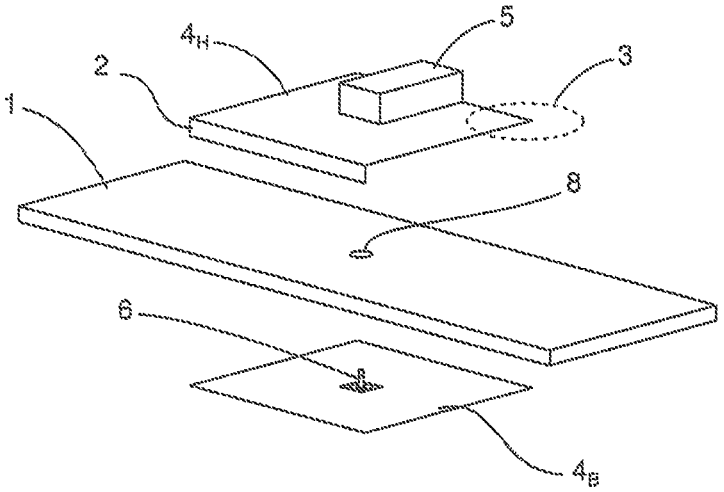
Figure 3:
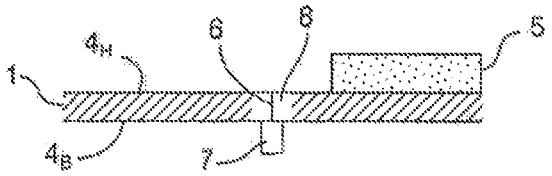
Figure 4:
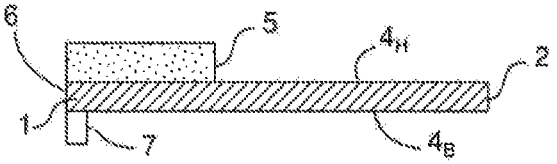
Figure 5:
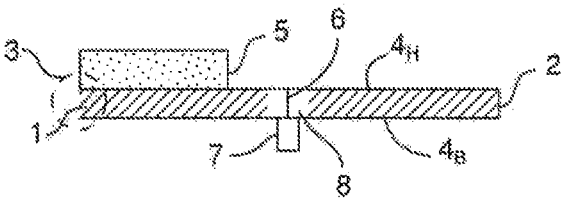
Figure 6:
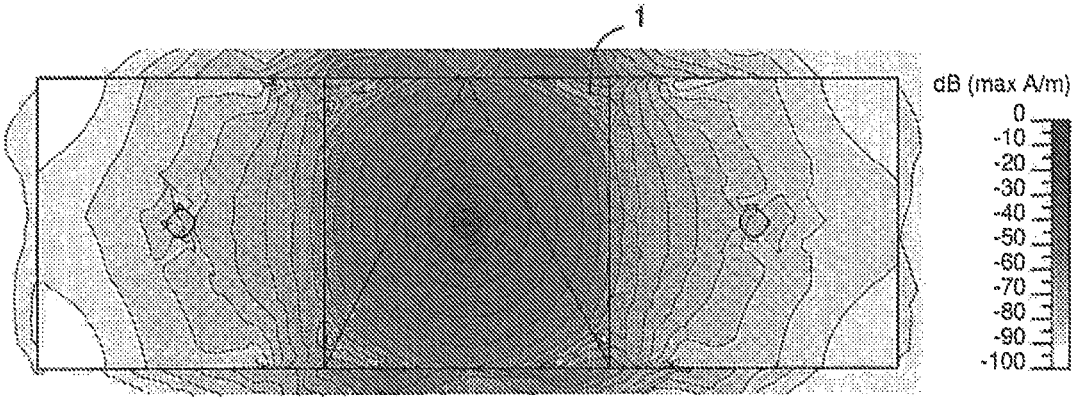
Figure 7:
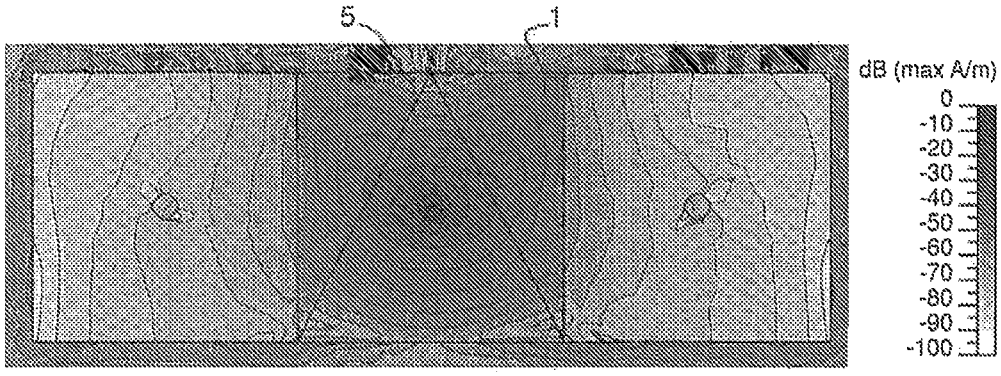
Figure 8:
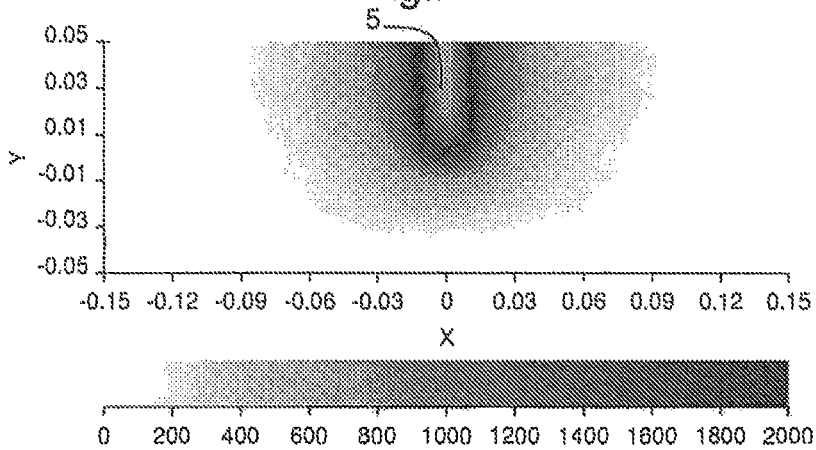
Figure 9:
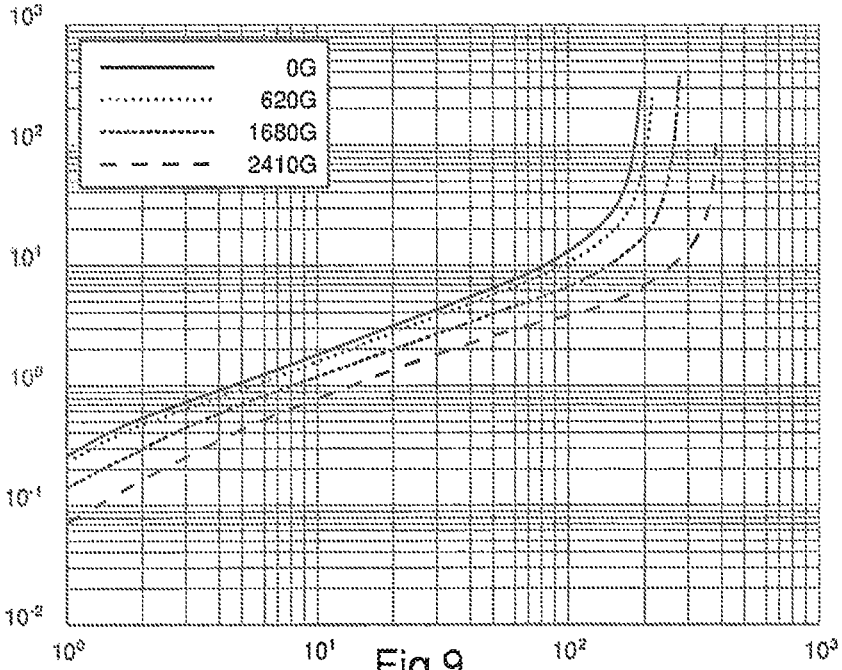
Figure 10A:
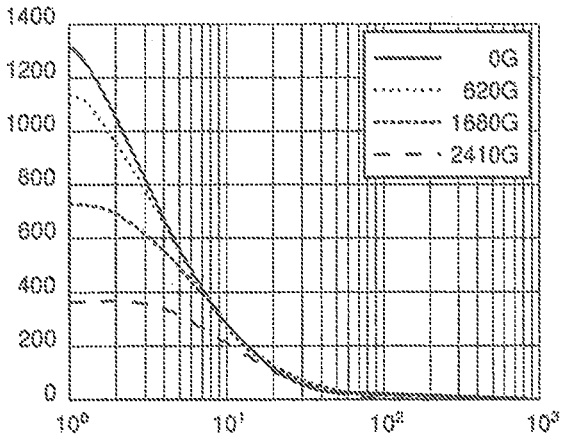
Figure 10B:
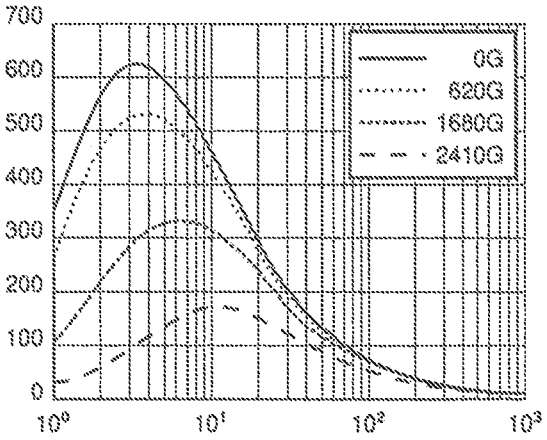
Figure 11A:
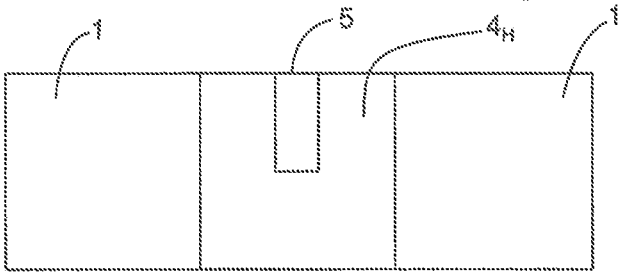
Figure 11B:
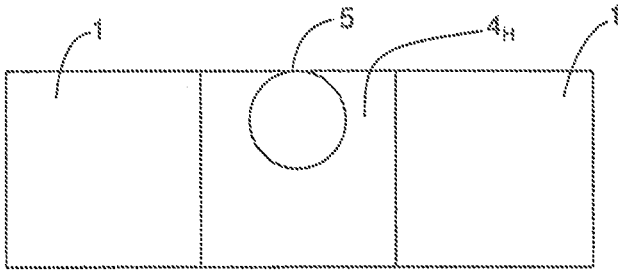
Figure 11C:
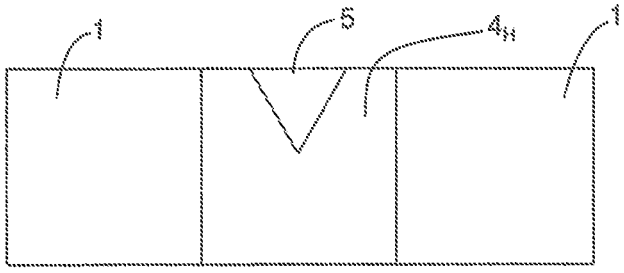
Figure 12:
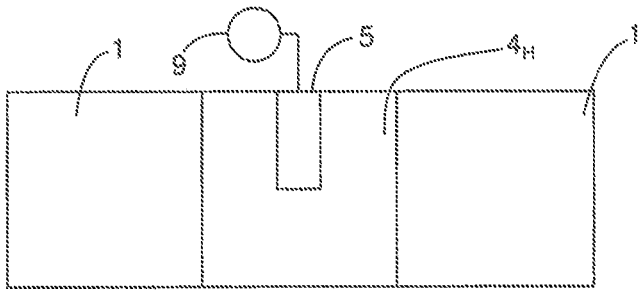
Figure 13:
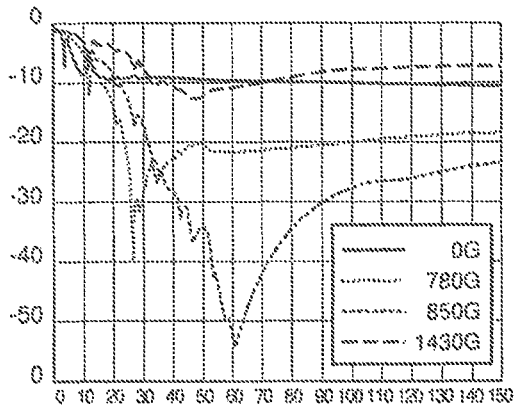
Figure 14:
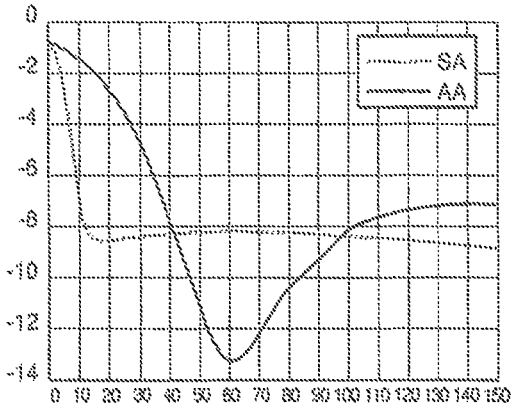
FIG. 14 is a graph representing the reflection coefficient $S_{11}$ of an antenna according to the first embodiment of the invention in the absence (SA curve—"no magnet") or in the presence (AA curve—"with magnet") of a permanent magnet of 2000 G, according to the frequency (in MHz). The antenna is here of the monopole type.
Figure 15:
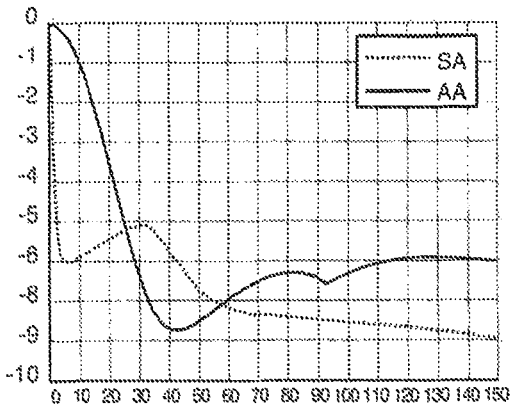
FIG. 15 is a graph representing the reflection coefficient $S_{11}$ of an antenna according to the second embodiment of the invention in the absence (SA curve) or in the presence (AA curve) of a permanent magnet of 2000 G, according to the frequency (in MHz). The antenna is here of the semi-open type.

The inserted part(s) 10 can take the place of the magnet (permanent or electromagnet) in all the embodiments of the antenna described above. Like the magnet, they can take different forms, like for example those presented in FIGS. 18*a*, 18*b* and 18*c*. The figures are similar to FIGS. 11*a*, 11*b* and 11*c* but the parts 10 are here inserted in the dispersive ferrite 1 instead of being arranged above on a metal plate (like the magnet). The hatched zones represented can be composed of one single part inserted in a block or of several parts inserted, arranged side-by-side. Different inserted parts can have permeabilities and/or a different loss tangent (always lower than the dispersive ferrite 1).

Like for the magnet, the forms can act on the features of the antenna, in particular its directivity.

Figure 19:
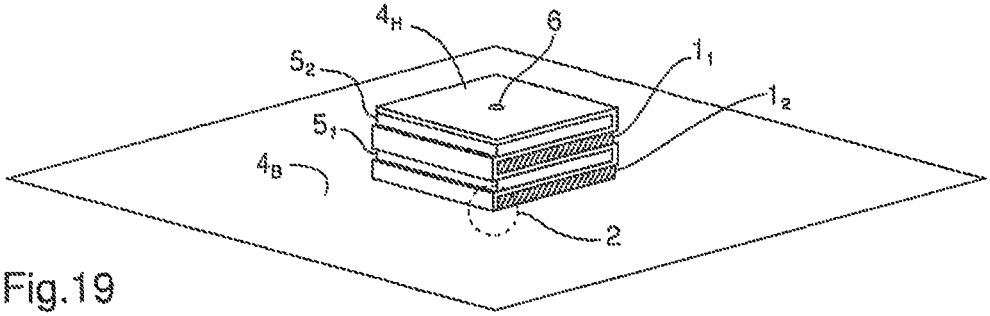

FIG. 19 represents schematically in perspective a so-called stacked antenna according to a fourth embodiment of the invention.

A stacked antenna according to the invention comprises several dispersive ferrites and several magnets stacked between the mass plane and at least one metal plate of the radiating portion.

In this fourth embodiment of the invention, the radiating portion $\mathbf{4}_H$ is formed of several metal plates connected in an S-shape or in a zigzag, between which are alternatively located, a dispersive ferrite or a magnet, such that there are as many dispersive ferrites as magnets. For example, here, the antenna comprises two dispersive ferrites $\mathbf{1}_1$ and $\mathbf{1}_2$ and two permanent magnets $\mathbf{5}_1$ and $\mathbf{5}_2$. The radiating portion $\mathbf{4}_H$ is connected to the plane $\mathbf{4}_B$ by a short-circuit 2. The excitor 6 passes through all the ferrites and magnets and does not affect the upper plate of the radiating portion $\mathbf{4}_H$.

Figure 20:
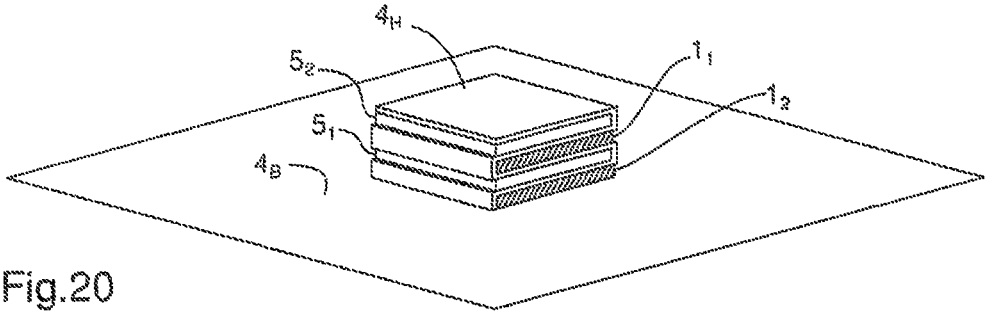

FIG. 20 represents schematically in perspective a so-called stacked antenna according to a fifth embodiment of the invention.

The antenna of this embodiment is identical to the fourth embodiment, except for the excitor being moved instead of the short-circuit and supplies the antenna between the mass plane $\mathbf{4}_B$ and the plate of the portion $\mathbf{4}_H$ which is closer to the mass plane $\mathbf{4}_B$.

Figure 21:
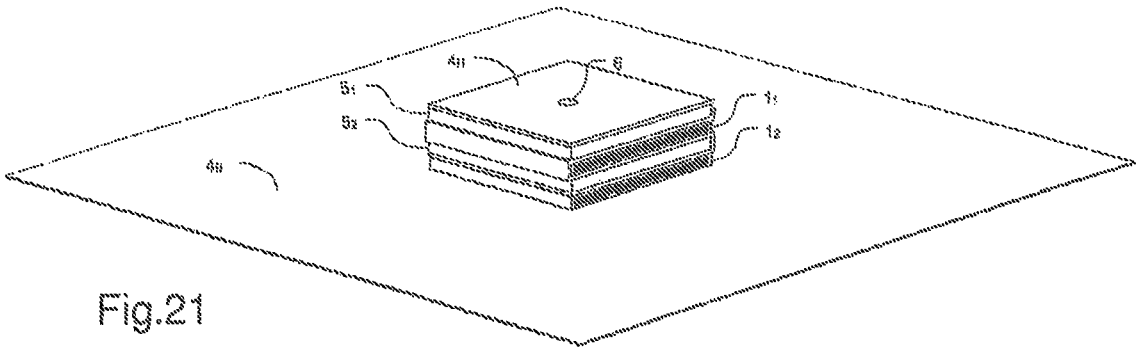

FIG. 21 represents schematically in perspective a so-called stacked antenna according to a sixth embodiment of the invention.

The antenna of this embodiment is identical to the fourth embodiment, except for it not comprising any short-circuit 2.

Figure 22:
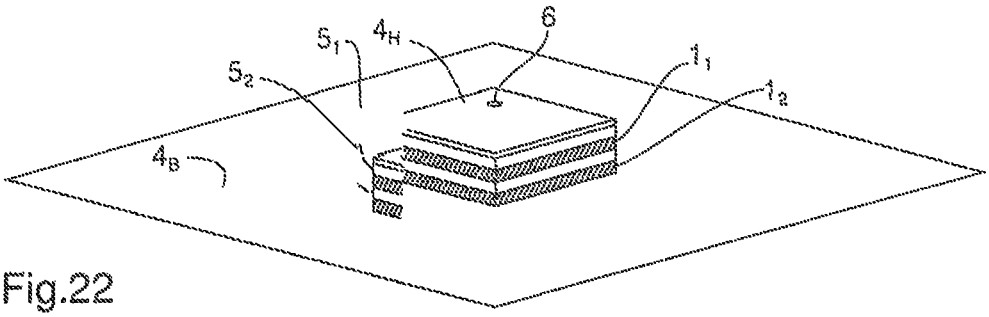

FIG. 22 represents schematically in perspective a so-called stacked antenna according to a seventh embodiment of the invention.

In this embodiment, the antenna comprises one single metal plate forming the radiating portion $\mathbf{4}_H$, and between the radiating portion $\mathbf{4}_H$ and the mass plane $\mathbf{4}_B$, a stack of dispersive ferrites and alternate magnets are located, here two dispersive ferrites $\mathbf{1}_1$ and $\mathbf{1}_2$ and two permanent magnets $\mathbf{5}_1$ and $\mathbf{5}_2$.

Figure 23:
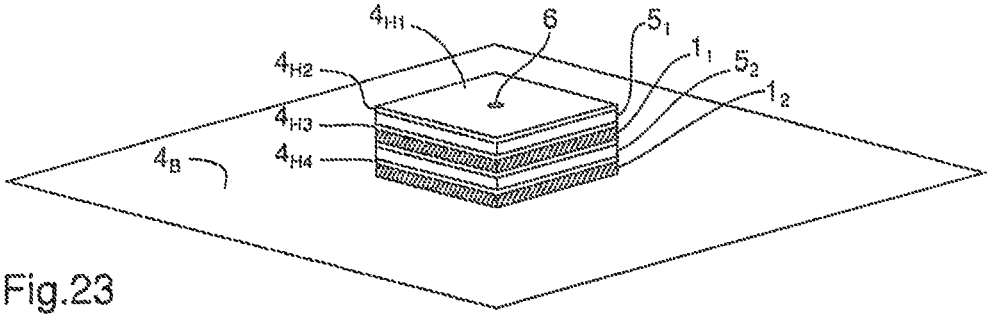

FIG. 23 represents schematically in perspective a so-called stacked antenna according to an eighth embodiment of the invention.

In this embodiment, the antenna comprises several metal plates $\mathbf{4}_{H1}$, $\mathbf{4}_{H2}$, $\mathbf{4}_{H3}$ and $\mathbf{4}_{H4}$ forming the radiating portion. Each metal plate is connected to the excitor 6. Between the mass plane $\mathbf{4}_B$ and the plate $\mathbf{4}_{H4}$, a dispersive ferrite $\mathbf{1}_2$ is located, between the plate $\mathbf{4}_{H4}$ and the plate $\mathbf{4}_{H3}$ a magnet $\mathbf{5}_2$ is located, between the plate $\mathbf{4}_{H3}$ and the plate $\mathbf{4}_{H2}$ a dispersive ferrite $\mathbf{1}_1$ is located, and between the plate $\mathbf{4}_{H2}$ and the plate $\mathbf{4}_{H1}$ a magnet $\mathbf{5}_1$ is located.

Figure 24:
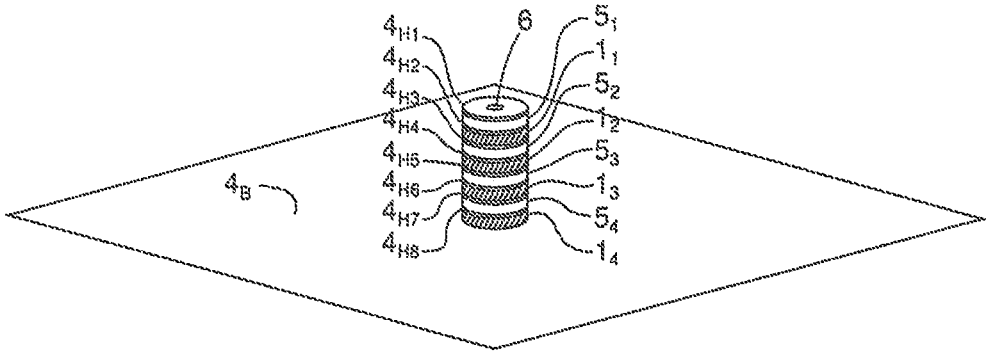

FIG. 24 represents schematically in perspective a so-called stacked antenna according to a ninth embodiment of the invention.

The antenna of this embodiment is similar to the eighth embodiment of the invention, in that it contains a plurality of metal plates $\mathbf{4}_{H1}$, $\mathbf{4}_{H2}$, $\mathbf{4}_{H3}$, $\mathbf{4}_{H4}$, $\mathbf{4}_{H5}$, $\mathbf{4}_{H6}$, $\mathbf{4}_{H7}$ and $\mathbf{4}_{H8}$ of circular form, forming the radiation portion and connected to the excitor 6. Between the metal plate, alternatively a dispersive ferrite $\mathbf{1}_1$, $\mathbf{1}_2$, $\mathbf{1}_3$ or $\mathbf{1}_4$ of circular form or a magnet $\mathbf{5}_1$, $\mathbf{5}_2$, $\mathbf{5}_3$ or $\mathbf{5}_4$ of circular form are located.

Figure 25:
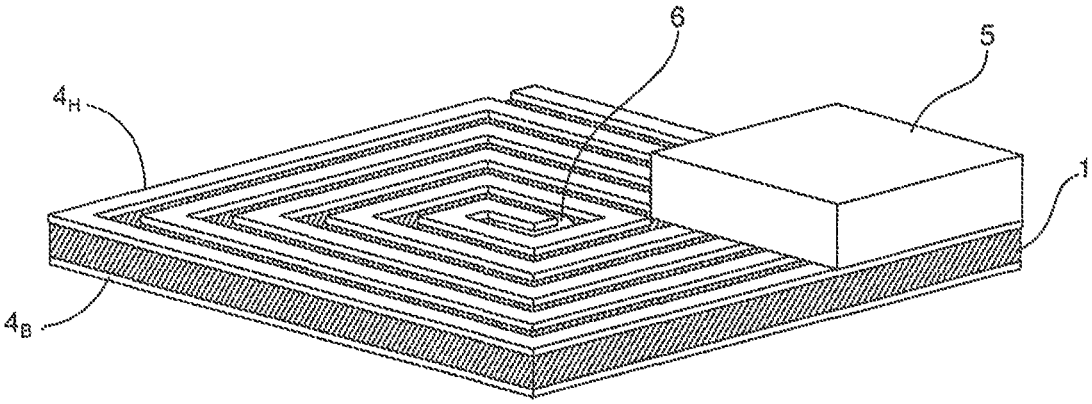
Figure 26:
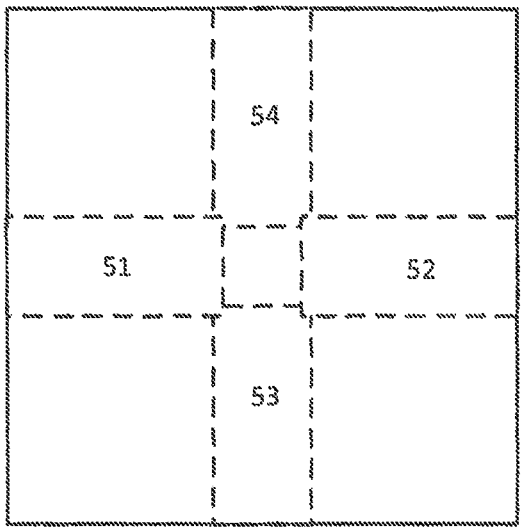
Figure 27:
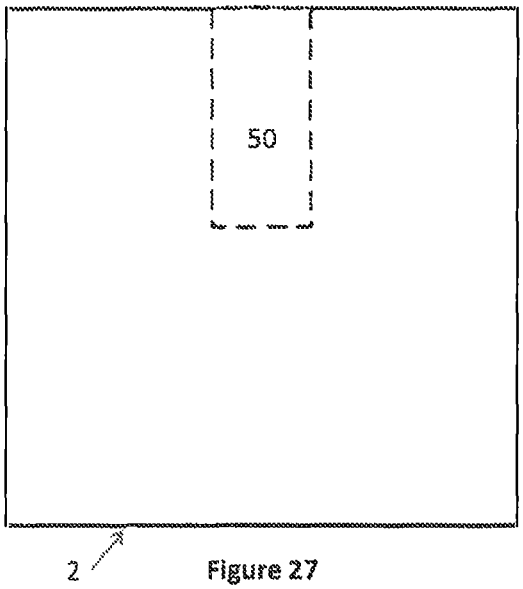

FIG. 25 represents schematically in perspective a so-called stacked antenna according to a ninth embodiment of the invention.

The antenna of this embodiment is similar to the first embodiment in that it comprises a magnet arranged on the radiating portion 4H of the antenna, this being separated from the mass plane 4B by the dispersive ferrite substrate 1.

According to a particularity of this embodiment, the second plate forming the radiating portion 4H is cut so as to form a rectangular flat spiral. For example, this spiral is centred on the excitor 6 of the antenna.

The invention is not limited only to the embodiments described. In particular, the dispersive ferrites, the magnets, the inserted parts or the metal plates can take different forms. The magnets can present values different from those indicated in the graphs. The stacked antennas can contain more layers.

The invention claimed is:

1. Antenna adapted to receive or emit at least one working frequency comprised in a kilometric (30-300 kHz), hectometric (0.3-3 MHz), decametric (3-30 MHz) and metric (30-300 MHz) band of frequencies, comprising:

at least two non-ferrous metal plates extending mainly according to a horizontal plane, at least one first plate forming a radiating portion and a second plate forming a mass plane, at least one substrate extending mainly according to a horizontal plane, arranged between the mass plane and the radiating portion, an excitor of length at least equal to the thickness of the substrate, extending between the mass plane and the radiating portion and connected to the radiating portion, and adapted to supply the antenna, said antenna wherein the substrate is a dispersive ferromagnetic substrate, called dispersive ferrite, presenting at said at least one working frequency, as magnetic features, a high relative magnetic permeability comprised between 10 and 10,000 and a high magnetic loss tangent greater than 0.1, said antenna comprising local modification means of the magnetic features of the dispersive ferrite, such that the relative magnetic permeability and the magnetic losses of the dispersive ferrite are reduced gradually and locally.

2. Antenna according to claim 1, wherein the local modification means of the magnetic features of the dispersive ferrite are a magnet arranged on one of the non-ferrous metal plates and generating a magnetic field leading to a gradual and local reduction of the relative magnetic permeability and magnetic losses of the dispersive ferrite.

3. Antenna according to claim 2, wherein the magnet is arranged on said at least one first plate forming a radiating portion of the antenna.

4. Antenna according to claim 2, wherein the magnet is a permanent magnet.

5. Antenna according to claim 2, wherein the magnet is an electromagnet, supplied by a variable direct current electric generator.

6. Antenna according to claim 5, wherein the radiating portion comprises a metal plate between each ferrite and magnet.

7. Antenna according to claim 2, wherein it comprises a succession of dispersive ferrite and of magnets stacked alternatively between the radiating portion and the mass plane.

8. Antenna according to claim 7, wherein the metal plates are connected between them.

9. Antenna according to claim 1, wherein the local modification means of the magnetic features of the dispersive ferrite are at least one material part having a low relative magnetic permeability and a low loss tangent inserted in the dispersive ferrite and leading to a gradual and local reduction of the magnetic permeability and of the magnetic losses of the dispersive ferrite.

10. Antenna according to claim 1, the dispersive ferrite presents a size in the horizontal plane greater than the size of the metal plates.

11. Antenna according to claim 1, wherein it comprises at least one short-circuit connecting the mass plane and the radiating portion, in contact with an edge of the dispersive ferrite.

* * * * *